US008225762B2

(12) United States Patent
Lancefield et al.

(10) Patent No.: US 8,225,762 B2
(45) Date of Patent: Jul. 24, 2012

(54) CAMSHAFT ASSEMBLY

(75) Inventors: Timothy Mark Lancefield, Shipston on Stour (GB); Ian Methley, Witney (GB); Richard Alwyn Owen, Banbury (GB); Nicholas James Lawrence, Buckingham (GB)

(73) Assignee: Mechadyne PLC, Kirtlington (GB)

( * ) Notice: Subject to any disclaimer, the term of this patent is extended or adjusted under 35 U.S.C. 154(b) by 747 days.

(21) Appl. No.: 12/092,248

(22) PCT Filed: Oct. 27, 2006

(86) PCT No.: PCT/GB2006/050361

§ 371 (c)(1),
(2), (4) Date: Apr. 30, 2008

(87) PCT Pub. No.: WO2007/052075

PCT Pub. Date: May 10, 2007

(65) Prior Publication Data

US 2008/0257104 A1 Oct. 23, 2008

(30) Foreign Application Priority Data

Nov. 2, 2005 (GB) ..... 0522328.4

(51) Int. Cl.
*F01L 1/34* (2006.01)

(52) U.S. Cl. ..... 123/90.17; 123/90.6

(58) Field of Classification Search ..... 123/90.17, 123/90.6; 74/567, 568 R; 29/888.1
See application file for complete search history.

(56) References Cited

U.S. PATENT DOCUMENTS

| | | | | |
|---|---|---|---|---|
| 5,235,939 | A * | 8/1993 | Levin et al. | 123/90.15 |
| 5,664,463 | A * | 9/1997 | Amborn et al. | 74/567 |
| 5,855,190 | A * | 1/1999 | Matsunaga | 123/90.17 |
| 6,386,165 | B1 * | 5/2002 | Eisenmann et al. | 123/90.17 |
| 6,481,401 | B1 * | 11/2002 | Schafer | 123/90.17 |
| 6,725,818 | B2 * | 4/2004 | Methley | 123/90.27 |

FOREIGN PATENT DOCUMENTS

| | | |
|---|---|---|
| EP | 0254058 | 1/1988 |
| EP | 254058 A2 * | 1/1988 |

* cited by examiner

*Primary Examiner* — Thomas Denion
*Assistant Examiner* — Daniel Bernstein
(74) *Attorney, Agent, or Firm* — Chernoff, Vilhauer, McClung & Stenzel

(57) ABSTRACT

The invention relates to a camshaft assembly comprising an inner shaft, an outer tube rotatable relative to the inner shaft, and two groups of cams mounted on the outer tube, the first group of cams being fast in rotation with the outer tube, and the second group being rotatably mounted on the outer surface of the tube and being connected for rotation with the inner shaft by means of connecting members that pass through circumferentially elongated slots in the outer tube. In the invention, the outer tube surrounds the inner shaft with clearance and the members connecting different ones of the cams of the second group to the inner shaft are inclined relative to one another and act to locate the axis of the inner shaft relative to the outer tube.

10 Claims, 3 Drawing Sheets

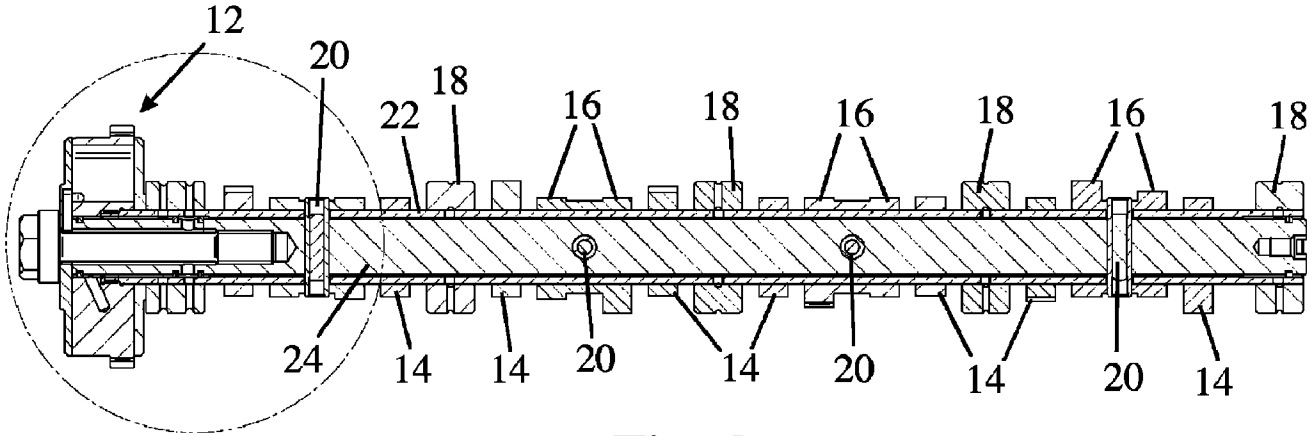
Fig. 3
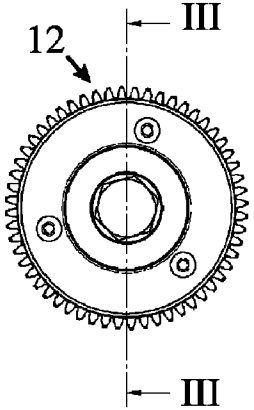
Fig. 2
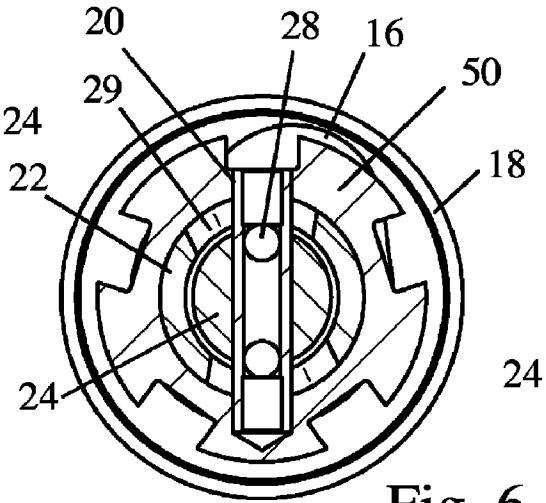
Fig. 5
Fig. 6
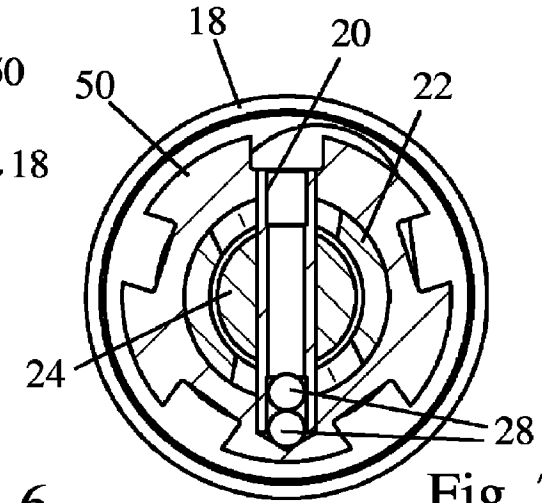
Fig. 7

CAMSHAFT ASSEMBLY

This is a national stage application filed under 35 USC 371 based on International Application No. PCT/GB2006/050361 filed Oct. 27, 2006, and claims priority under 35 USC 119 of United Kingdom Patent Application No. 0522328.4 filed Nov. 2, 2005.

FIELD OF THE INVENTION

The present invention relates to a camshaft assembly comprising an inner shaft, a coaxial outer tube rotatable relative to the inner shaft, and two groups of cams mounted on the outer tube, the first group of cams being fast in rotation with the outer tube and the second group of cams being rotatably mounted on the tube and being connected for rotation in phase with the inner shaft by means of connecting members that pass through circumferentially elongated slots in the outer tube. This type of camshaft assembly, herein also termed an "SCP camshaft", allows the timing of its two groups of cams to be varied in relation to one another by relative rotation of the outer tube and the inner shaft.

BACKGROUND OF THE INVENTION

SCP camshafts should not be confused with camshafts of the type described in DE 4419557 where the inner shaft can intentionally be moved radially relative to the outer tube into an eccentric position for the purpose of achieving variable event duration by superimposing a cyclic phase change on the phase of a cam lobe connected to both the inner shaft and the outer tube. In an SCP camshaft the inner shaft and outer tube rotate at all times about fixed substantially concentric axes.

An example of an SCP camshaft is described in U.S. Pat. No. 5,664,463. As is shown in the latter patent, the inner shafts of known SCP camshafts are supported in bushes or bearings within the outer tubes. This results in the camshafts being sensitive to component manufacturing tolerances.

In particular, the alignment of the holes in the inner shaft and those in the movable cams into which each of the connecting members is fitted is critical. If significant misalignment is present, the fitting of the connecting member will act to align the holes and this will cause the drive shaft to lock in its bearings in the outer tube of the camshaft. Variation in components due to manufacturing tolerances can therefore result in the inner shaft being unable to rotate relative to the outer tube of the camshaft. The need for the component parts of the camshaft to be made to an accurate specification increases the manufacturing cost of the camshaft.

OBJECT OF THE INVENTION

The present invention seeks therefore to provide a design for reducing the tolerance sensitivity of an SCP camshaft assembly.

SUMMARY OF THE INVENTION

According to the present invention, there is provided an SCP camshaft, as above defined, which is characterised in that the outer tube surrounds the inner shaft with clearance such that the inner shaft is not radially supported by the outer tube at any point along the length of the inner shaft and in that the members connecting different ones of the cams of the second group to the inner shaft are inclined relative to one another and act to locate the axis of the inner shaft relative to the outer tube.

The invention overcomes the effect of manufacturing tolerances by allowing the position of the inner drive shaft axis to be dictated not by bearings or bushes supporting the inner shaft in the outer tube but by the connecting members that transmit torque between the inner shaft and the movable cams. The inner drive shaft is not directly supported by outer tube, but instead passes through the inner bore of the outer tube with clearance long its entire length. This eliminates the possibility of the drive shaft becoming locked against the inside of the tube when the connecting pins are fitted.

It is advantageous for two of the connecting members associated with different cams of the second group to be substantially perpendicular to each other in order to achieve more positive centring of the inner shaft.

The connecting members may be solid pins fixed relative to the inner shaft, such as by a shrink fit, and slidably received in the second group of cams.

Alternatively, the connecting members may be hollow pins which are a sliding fit in the inner shaft and are locked in position once the inner shaft has found a centralised position. In the latter case, one or more balls may be used to expand the hollow pins to lock them in position once the inner shaft has found a centralised position.

If the connecting pins are to be driven in a blind bore, their removal can be facilitated by providing a position of clearance at the end of each pin into which the balls can be pushed to free the pin from the inner shaft.

A preferred embodiment of the invention makes use of flexible seals between the inner drive shaft and the bore of the outer tube to produce a number of separate cavities or conduits that can be used for lubrication of the camshaft, or to feed control oil under pressure to a camshaft phaser.

BRIEF DESCRIPTION OF THE DRAWINGS

The invention will now be described further, by way of example, with reference to the accompanying drawings, in which:

FIG. 2 is an end view of the camshaft assembly of FIG. 1 as seen from the end on which the phaser is mounted, FIG. 3 is a longitudinal section through the camshaft assembly of FIG. 1 taken along the line III-III in FIG. 2, FIG. 5 is an axial section passing through a connecting pin of one embodiment of the invention, FIG. 6 is an axial section similar to that of FIG. 5 showing an alternative embodiment of the invention, and FIG. 7 is a similar section to that of FIG. 6 showing the manner in which a connecting pin can be withdrawn when fitted within a blind bore.

DETAILED DESCRIPTION OF THE PREFERRED EMBODIMENTS

Figure 1:
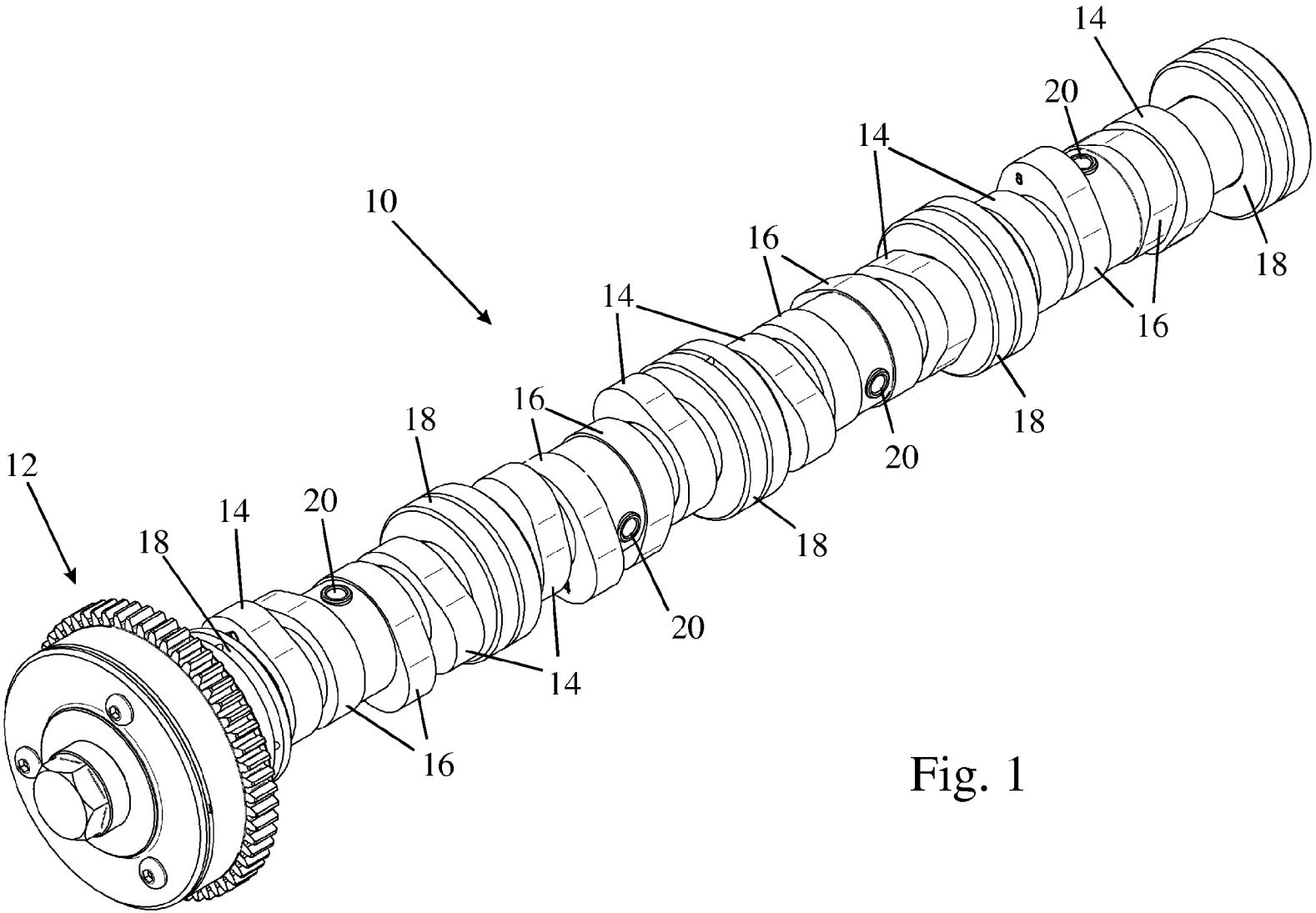
FIG. 1 is a perspective view of a camshaft assembly of the present invention fitted with a camshaft phaser.

FIGS. 1 to 4 show an assembled camshaft 10 with a camshaft phaser 12 mounted on one of its ends. The phaser 12 is not described in detail but may for example be a vane type phaser as described in GB 0428063.2. The assembled camshaft 10 comprises an outer tube 22 and an inner shaft 24 arranged within the outer tube 22 but not supported by it nor making direct contact with it. Directly mounted on the outer tube 22 for rotation therewith are cams 14 of a first group and support bearings 18. The bearings 18 and cams 14 may for example be heat shrunk onto the outer tube 22.

A plurality of sleeves formed with cams 16 of a second group are mounted to rotate freely about the outer surface of the outer tube 22 and are connected by means of pins 20 for rotation with the inner shaft 24. As can be seen from FIGS. 1 and 3, the axes of the two end pins 20 are arranged in a plane perpendicular to that containing the axes of the two remaining intermediate pins 20. Because of the mutual inclination of the connecting pins 20 (they need to be inclined but not necessarily perpendicular to one another), they together act to locate the axis of the inner shaft 24 in relation to the axis of the outer tube 22. Because the inner shaft 24 is not otherwise supported within the outer tube 22, there are no conflicting forces acting which could cause the inner shaft 24 to lock up within the outer tube 22 and the axis of the inner shaft 24 will naturally float into central position within the outer tube 22.

Figure 4:
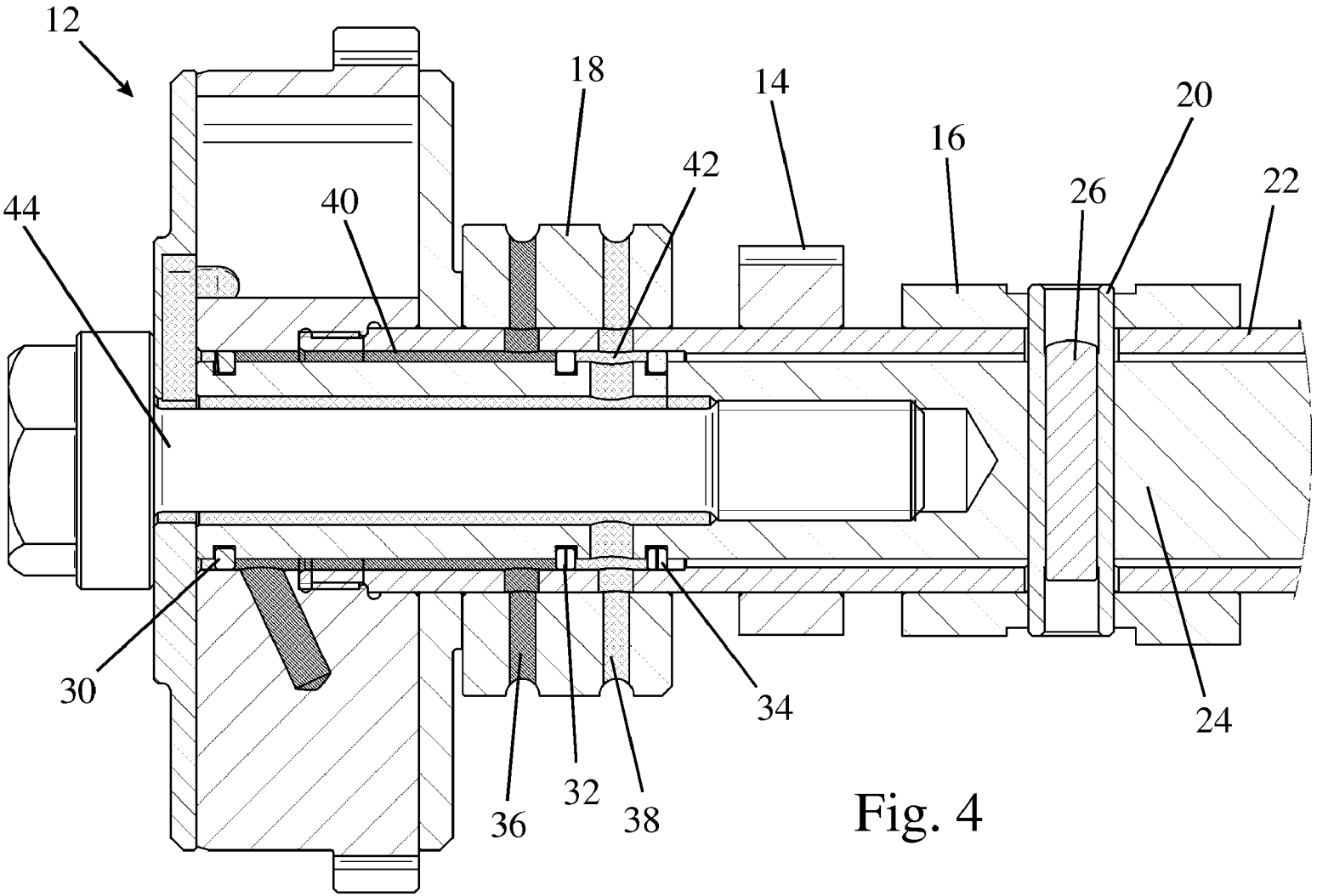
FIG. 4 shows to an enlarged scale a detail of the section of FIG. 3 contained within a chain dotted circle.

Though the cams 16 can be connected to the shaft 24 by means of solid pins that are an interference fit within the inner shaft 24, it is preferred, to use connecting pins constructed as hollow tubes 20 that are expanded in situ to lock the pins to the inner shaft 24 either by means of a bullet 26, as shown in FIG. 4, or by means of balls 28 as shown in FIG. 5. It is advantageous to use balls to lock the connecting pin 20 into position because they create a more localised deformation and require less force to insert. This in turn allows the component tolerances to be relaxed because the insertion force does not vary over a large range as manufacturing tolerances change.

The connecting pins 20 have a smaller inner diameter than the outer diameter of the bullet 26 or the balls 28, so that when the balls 28 are inserted into the pins 20 the pins expand and become locked within the inner shaft 24. The outer ends of the pins 20, however, remain a sliding fit within the cams 16 and they do not to interfere with the rotation of the second group of cams 16 about the outer surface of the tube 22.

FIG. 5 illustrates an embodiment in which each pin 20 is mounted within a through bore. This figure also shows the circumferentially elongated slots 29 which allow the cams 16 of the second ground to rotate about the outer tube 22.

It is alternatively possible for the pins 20 to be received within blind bores and such an embodiment is shown in FIGS. 6 and 7 where the pin 20 is shown passing through a sensor ring 50. In order to permit extraction of a pin 20 when it is fitted within a blind bore, it is possible to provide a region at the blind bore end of the pin 20 in which the balls 28 are received with clearance, as shown in FIG. 7. When the balls 28 are pushed into this region, the pin 20 can be extracted by gripping its other end. This gripping may be facilitated by providing a screw thread or transverse holes that can be engaged by a suitable extraction tool.

As is shown in FIG. 4, by providing resilient seals 30, 32 and 34 one can form between the inner shaft 24 and the outer tube 22 passages along which oil may flow either to lubricate moving parts of the assembled camshaft or to supply oil to working chambers of the hydraulically operated phaser 12. In the case of the embodiment illustrated in FIG. 4, the phaser 12 is a vane type phaser having working chambers on opposite sides of radially extending vanes. Bores 36 and 38 are formed in the bearing sleeve 18 to supply oil to these working chambers. The bore 36 communicates with one set of working chambers through a conduit 40 defined between the inner shaft 24 and the outer tube 22. The opposite ends of this conduit 40 are sealed by the resilient seals 30 and 32. The bore 38 communicates with the other set of working chambers of the phaser 12 through a chamber of 42 defined between the seals 32 and 34. The chamber 42 communicates through radial bores in the inner shaft 24 with an annular passageway defined between the inner shaft 24 and the shaft of a bolt 44 that is used to retain the phaser 12 on the axial end of the assembled camshaft 10.

A third chamber is defined between the inner shaft 24 and the outer tube 22, its ends being sealed by the resilient seal 34 and a corresponding seal inside the rear bearing of the camshaft as shown in FIG. 3. Oil is fed into this chamber via drillings in the bearings 18 that also pass through the outer tube 22. The oil from the chamber acts to lubricate the bearing surface between the cams 16 and the outer tube 22 by flowing out through the elongated slots 29 in the tube 22.

In the illustrated embodiments, the connecting pins 20 have been locked in the inner shaft whilst having a sliding fit in the moving cams in order to let the inner drive shaft move to a centralised position. It is however alternatively possible for the connecting pins 20 to be radially fixed in relation to the movable cams 16 and to slide relative to the inner shaft 24. Once again, the pins 20 can be made of hollow construction, but it is their ends that are expanded to grip the cams 16 instead of their central section being expanded to grip the inner shaft 24.

The embodiments of the invention described above offer the following advantages, namely:

Components can be manufactured to a lower level of accuracy.

No accurate bearing features are required on the inner shaft or outer tube.

Reduced cost of overall system.

The axis of rotation of the inner shaft will always be concentric to the outer diameter of the tube.

The invention claimed is:

1. A camshaft assembly comprising an inner shaft, a coaxial outer tube rotatable relative to the inner shaft, and two groups of cams mounted on the outer tube, the first group of cams being fast in rotation with the outer tube and the second group of cams being rotatably mounted on the tube and being connected for rotation in phase with the inner shaft by means of connecting members that pass through circumferentially elongated slots in the outer tube, characterised in that the outer tube surrounds the inner shaft with clearance such that the inner shaft is not radially supported by the outer tube at any point along the length of the inner shaft and in that the members connecting different ones of the cams of the second group to the inner shaft are inclined relative to one another and act to locate the axis of the inner shaft relative to the outer tube.

2. A camshaft assembly as claimed in claim 1, wherein two of the connecting members associated with different cams of the second group are substantially perpendicular to one another.

3. A camshaft assembly as claimed in claim 1, wherein the connecting members are solid pins fixed relative to the inner shaft and slidably received in the second group of cams.

4. A camshaft assembly as claimed in claim 1, wherein the connecting members are hollow pins which are a sliding fit in the inner shaft and are locked in position relative to the inner shaft of the cams of the second group once the inner shaft has found a centralised position.

5. A camshaft assembly as claimed in claim 4, wherein at least one ball is provided to expand the connecting members to lock them in position once the inner shaft has found a centralised position.

6. A camshaft assembly as claimed in claim 5, wherein the connecting pins are designed to allow the balls to be pushed into a position of clearance, allowing the connecting pins to be removed when mounted in blind bores.

7. A camshaft assembly as claimed in claim 1, wherein at least one flexible seal is provided to seal between the outer tube and the inner shaft.

8. A camshaft assembly as claimed in claim 7, wherein a plurality of flexible seals are provided to define a plurality of separate oil passages between the outer tube and inner shaft.

9. A camshaft assembly as claimed in claim 8, wherein oil passages within the camshaft communicate in use with working chambers of camshaft phaser mounted on one end of the camshaft.

10. A camshaft assembly as claimed in claim 8, wherein oil passages within the camshaft provide lubrication to the moving parts of the camshaft.

* * * * *